United States Patent [19]

Steltenkamp

[11] Patent Number: 4,828,722

[45] Date of Patent: May 9, 1989

[54] THROUGH THE WASH FABRIC CONDITIONING COMPOSITIONS

[75] Inventor: Robert J. Steltenkamp, Somerset, N.J.

[73] Assignee: Colgate-Palmolive Co., Piscataway, N.J.

[21] Appl. No.: 106,978

[22] Filed: Oct. 2, 1987

Related U.S. Application Data

[63] Continuation of Ser. No. 884,156, Jul. 10, 1986, abandoned.

[51] Int. Cl.[4] ..... D06M 13/20; D06M 13/34; C11D 1/65

[52] U.S. Cl. ..... 252/8.8; 252/525; 252/539; 252/544; 252/8.6; 252/527; 252/547

[58] Field of Search ..... 252/8.8, 8.6, 142, 148, 252/544, 132

[56] References Cited

U.S. PATENT DOCUMENTS 4,294,718 10/1981 Kaeser ..... 252/135

FOREIGN PATENT DOCUMENTS 0123400 10/1984 European Pat. Off. .

*Primary Examiner*—Paul Lieberman
*Assistant Examiner*—John F. McNally
*Attorney, Agent, or Firm*—Bernard Lieberman; Murray M. Grill

[57] ABSTRACT

Fabric conditioning compositions which impart softness and anti-static properties are provided for through-the-wash use in conjunction with machine dryers. The fabric conditioning compositions comprise complexes of specified tertiary amine and multi-functional carboxylic acids.

23 Claims, No Drawings

THROUGH THE WASH FABRIC CONDITIONING COMPOSITIONS

This application is a continuation of application Ser. No. 884,156 filed July 10, 1986, now abandoned.

TECHNICAL FIELD

This invention relates to novel through-the wash fabric conditioning compositions which, when carried through the normal wash, rinse and dry cycles encountered during home or commercial laundering, result in softening and antistatic benefits to the laundered fabrics without adversely affecting cleaning.

BACKGROUND OF THE INVENTION

A large number of compositions have been disclosed which impart softening and antistatic properties to laundered fabrics. Generally, these contain cationic compounds, especially quaternary and imidazolinium salts. These compositions are widely marketed for home use in the form of emulsions which are added to the washing machine during the rinse cycle. If these emulsions are added during the wash cycle the cationic fabric conditioners interact with anionic substances present in the washing composition (laundry detergent), thus rendering both relatively ineffective.

Another means of providing fabric conditioning which has attained some commercial success is to add the conditioning agent while the clothes are being machine dried.

While fabric conditioning during either the rinse and/or drying cycles can be effective, both methods are more inconvenient than a through-the-wash method would be, where the conditioning agent is added with the detergent at the initiation of the wash cycle.

Certain compositions are already known which provide fabrics with a detergency treatment in a washing machine, combined with a fabric conditioning treatment in a subsequent dryer machine. Compositions of this type are known in the art as through-the-washing conditioners. These are convenient to use in that they do not require the use of a second product in the rinse or dryer cycle.

Through-the-wash type conditioning agents are well known in the art. European Patent Publication No: 0,123,400, published Oct. 31, 1984 discloses detergent compositions containing salts of specified tertiary amines and Carboxylic acids which are utilized in the form of nodules which pass virtually unchanged through the wash and rinse, and condition the fabric when heated in a dryer. More recently, European Patent Publication No. 0,133,804 published Mar. 6, 1985 discloses detergent compositions containing clay fabric softeners and particles of a complex of a long chain amine and a fatty acid. U.S. Pat. No. 4,514,444 to Ives discloses a fabric cleaning/conditioning composition comprising carboxylic acid salts of a tertiary amine in combination with polyethylene glycol U.S. Pat. No. 4,375,416 to Crisp et al discloses a textile softening detergent composition comprising a specified class of tertiary amines with a smectite-type clay.

Other recent prior art relating to the field of the invention includes U.S. Pat. No. 4,237,155 to Kardouche which discloses a dryer-added fabric conditioning agent comprised of a carboxylic acid salt of a tertiary amine.

SUMMARY OF THE INVENTION

The present invention provides a fabric conditioning composition capable of imparting softness and anti-static properties to±fabrics treated therewith in a laundry bath without adversely affecting fabric cleaning comprising a fabric conditioning amount of a multicarboxylic acid complex of a tertiary amine formed from (i) an amine having the general formula:

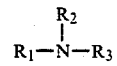

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tri carboxylic acids having 21 to 54 carbon atoms.

In accordance with a preferred embodiment of the invention the fabric conditioning composition of the invention is supported upon a carrier such as free flowing porous base beads which are then advantageously used an an additive to the laundry bath in conjunction wiht a liquid or granular detergent composition. The porous base beads are conveniently comprised of from about 50 to 90%, by weight, of an inorganic or organic detergent builder salt, the balance comprising water and optionally adjuvants.

In accordance with another preferred embodiment, the fabric conditioning composition of the invention is formulated to be a component of an aqueous liquid emulsion which may be conveniently added to the laundry bath during the wash cycle in conjunction with a liquid or granular detergent composition. A liquid emulsion of this type may have the following composition by weight to provide an effective and convenient wash-cycle additive product:

(a) from about 10 to 30%, preferably about 15 to 25%, of the above-defined fabric conditioning composition of the invention;

(b) from about 10 to 30% of an emulsifying agent such as ethanol or a suitable nonionic detergent compound such as Neodol® 25-3; and (c) the balance water and optionally an anti-static composition additional to the fabric conditioning composition of component (a) to enhance the anti-static properties of the wash-cycle additive liquid emulsion. A preferred additional anti-static composition for this purpose is tallow neodecanamide.

In accordance with the process aspect of the invention, softness and anti-static properties are imparted to fabrics by contacting such fabrics with an effective amount of a fabric conditioning composition comprising a multicarboxylic acid complex of a tertiary amine formed from (i) an amine having the general formula:

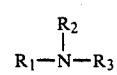

wherein $R_1$ is methyl or ethyl and $R_2$ and $R_3$ are each independently an aliphatic group having from 12 to 22 carbon atoms, and (ii) a multi-functional carboxylic acid selected from the group consisting of citric acid, and di and tri carboxylic acids having 21 to 54 carbon atoms.

The present invention is predicated on the discovery that complexes of amines with multicarboxylic acids formed from the reaction of a tertiary amine and specific multifunctional carboxylic acids as defined herein are capable of providing softness and anti-static properties to fabrics in a wash bath without adversely affecting fabric cleaning. Thus, the invention avoids the characteristic problem generally associated with the use of amine salts of carboxylic acids described in the prior art or amine salts of dicarboxylic acids not in accordance with the invention, namely, materials which provide anti-static properties but no softness or provide moderate softness with unacceptable anti-static properties. Moreover, unlike known fabric conditioners such as cationic compounds, and in particular quaternary ammonium compounds, the fabric conditioning composition of the invention are intended to be added to the wash bath because they do not react with anionic substances in the bath so as to adversely affect the overall cleaning of the soiled fabrics.

DETAILIED DESCRIPTION OF THE INVENTION

The fabric conditioning compositions of the invention are complexes of a tertiary amine with a multi-functional carboxylic acid as herein defined. The suitable tertiary amines are represented by the general formula

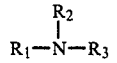

wherein $R_1$ is methyl or ethyl, and $R_2$ and $R_3$ are each independently an aliphatic group having from 12 to 22 carbon atoms. Examples of preferred amines include methyl distearyl amine, ethyl distearyl amine, methyl di(hydrogenated tallow) amine, ethyl di(hydrogenated tallow) amine, methyl dioleylamine, methyl dicoconut amine, methyl dilaurylamine, and methyl dipalm oil amine.

The multi-functional carboxylic acid utilized in the present invention is selected from among citric acid and di and tri carboxylic acids having 21 to 54 carbon atoms. Preferred for use herein are citric acid; a dicarboxylic acid having 21 carbon atoms e.g. 5 (or 6)-carboxy-4 hexyl-2-cyclohexene-1-octanoic acid. This $C_{21}$ dicarboxylic acid is sold commercially under the tradename Westvaco Diacid 1550 by Westvaco Corporation; dimerized oleic acid (sold commercially under the tradename Dimer Acid by Emergy Industries); and a $C_{54}$ trimer of oleic acid.

The amine-multicarboxylic acid complexes of the invention are prepared by forming a mixture of amine and multicarboxylic acid, preferrably in a molar ratio of amine to carboxylic acid of 1:1 to 1:2, and then heating such mixture to a temperature of from about 90° to 110° C. for a period of about 10 to 30 minutes. The most suitable time and temperature within these ranges for effecting the formation of the desired complex rather than an amine-carboxylic acid salt may vary depending upon the particular combination of amine and carboxylic acid selected. In general, heating at a temperature of about 100° C. for a period of about 15 minutes is a favorable reaction condition for forming the aminemulticarboxylic acid complex.

Taking as an example the interaction between methyl di(hydrogenated tallow) amine and dimerized oleic acid at the aforementioned reaction conditions, the resulting reaction product was identified as a weak hydrogen bonded complex (80 wt.%) in equilibrium with the corresponding salt (20 wt. %). Identification was based on measurements involving melting points and spectroscopic techniques. The complex melted at 28° to 31° C. which is intermediate between the melting point of the amine (34° to 38° C.) and the carboxylic acid (4° to 5° C.). This indicates the formation of a complex rather than an amine salt, the latter having sharp melting points higher than the corresponding amine.

The infra red spectrum of the complex shows the presence of two moderate carbonyl bands at wavelengths of 1709 $cm^{-1}$ and 1550 $cm^{-1}$. The 935 $cm^{-1}$ wavelength indicative of H-bonding of the particular free carboxylic acid is absent, indicating the presence of a complex rather than salt formation. By means of ESCA (Election Spectroscopy for Chemical Analysis) measurements, it was determined that the reaction product was about 20% amine salt and 80% of the desired amine-carboxylic acid complex. The chemical shift of the ionic nitrogen of the salt was different than that of the neutral nitrogen of the complex. The relative amounts of these two nitrogen signals provide the basis for determining the relative amounts of amine salt versus amine complex.

The fabric conditioning compositions of the invention may be advantageously added to a laundry bath or to the rinse liquor supported upon a carrier independent of any detergent, or such conditioning composition may be incorporated into a fully formulated detergent composition as a component thereof. When used as laundry bath or rinse cycle additive independent of any detergent, the fabric conditioning composition is preferably applied to free-flowing porous base beads comprised of about 50 to 90%, more preferably, 65 to 85%, by weight, of an inorganic or organic detergent builder salt, such as pentasodium tripolyphosphate, or water softening aluminum silicate, namely, a zeolite. The balance of the base beads is essentially comprised of water and may contain 5 to 15%, by weight, of sodium silicate, and optionally adjuvants such as dyes or processing aids such as polyacrylate.

The zeolite used in the base beads is usually synthetic and it is often characterized by having a network of substantially uniformly sized pores in the range of about 3 to 10 Angstroms, often being about 4 Å (normal), such size being uniquely determined by the unit structure of the zeolite crystal. Preferably it is of type A or similar structure, particularly described at page 133 of the text "Zeolite Molecular Sieves" by Donald Breck, published in 1974 by John Wiley & Sons. Good results have been obtained when a Type 4Å molecular sieve zeolite is employed wherein the univalent cation of the zeolite is sodium and the pore size of the zeolite is about 4 Angstroms. Such Zeolite molecular sieves are described in U.S. Pats. Nos. 2,882,243 and 3,114,603. The zeolite may be amorphous or crystalline and have water of hydration as known in the art.

A fully formulated detergent composition containing an effective amount of an amine-multicarboxylic acid complex in accordance with the invention is capable of proving effective cleaning and softening concomitant with imparting anti-static properties to the laundered fabrics. The amine-multicarboxylic acid complexes may be present in such fully formulated detergent compositions in an amount of from about 0.5 to 15% preferably from about 3 to 9%, based on the total weight of the composition.

A suitable detergent and conditioning composition should contain:

(a) from about 5 to 50%, by weight, of at least one detergent compound;

(b) from about 5 to 75%, by weight, of an organic or organic detergent builder;

(c) from about 0.5% to 15%, by weight, of a multifunctional carboxylic acid complex of a teriary amine formed from (i) an amine having the general formula

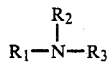

wherein $R_1$ is methyl or ethyl, and $R_2$ and $R_3$ are each independently an aliphatic group having from 12 to 22 carbon atoms; and (ii) a multifunctional carboxylic acid selected from the group consisting of citric acid, and di and tri carboxylic acids having 21 to 54 carbon atoms; and (d) the balance water and optionally a filler salt.

A preferred detergent and conditioning composition, in accordance with the invention contains from about 10 to 20% by weight, of an anionic detergent and from about 20 to 30% of a detergent builder. In accordance with another embodiment, the detergent composition contains from about 15 to 25%, by weight, of a nonionic detergent compound and from about 50 to 60% of a detergent builder.

Various anionic detergents, usually as sodium salts, may be employed but those which are most preferred are linear higher alkyl benzene sulfonates, higher alkyl sulfates and higher fatty alcohol polyethoxylate sulfates. Preferably, in the higher alkyl benzene sulfonate the higher alkyl is linear and of 12 to 15 carbon atoms, e.g., 12 or 13, and is a sodium salt. The alkyl sulfate is preferably a higher fatty alkyl sulfate of 10 to 18 carbon atoms, preferably 12 to 16 carbon atoms, e.g., 12, and is also employed as the sodium salt. The higher alkyl ethoxamer sulfates will similarly be of 10 or 12 to 18 carbon atoms, e.g., 12, in the higher alkyl, which will preferably be a fatty alkyl, and the ethoxy content will normally be from 3 to 30 ethoxy groups per mole, preferably 3 or 5 to 20. Again, the sodium salts are preferred. Thus, it will be seen that the alkyls are preferably linear or fatty higher alkyls of 10 to 18 carbon atoms, the cation is preferably sodium, and when a polyethoxy chain is present the sulfate is at the end thereof. Other useful anionic detergents of this sulfonate and sulfate group include the higher olefin sulfonates and paraffin sulfonates, e.g., the sodium salts wherein the olefin or paraffin groups are 10 to 18 carbon atoms. Specific examples of the preferred detergents are sodium linear dodecylbenzene sulfonate, sodium tridecylbenzene sulfonate, sodium tallow alcohol polyethoxy (3 E+O) sulfate, and sodium hydrogenated tallow alcohol sulfate. In addition to the preferred anionic detergents mentioned, others of this well known group may also be present, especially in only minor proportions with respect to those previously described. Also, mixtures thereof may be employed and in some cases such mixtures can be superior to single detergents. The various anionic detergents are well known in the art and are described at length at pages 25 to 138 of the text *Surface Active Agents and Detergents,* Vol. II, by Schwartz, Perry and Berch, published in 1958 by Interscience Publishers, Inc.

Small portions of fatty acid soaps, e.g., sodium soaps of fatty acids of 10 to 22 carbon atoms, preferably 14 to 18 carbon atoms, e.g., sodium hydrogenated tallow fatty acids soaps, can be employed, when less foam in the washing machine is desirable.

Nonionic detergents of satisfactory physical characteristics may be utilized in place of or with anionic detergents, including condensation products of ethylene oxide and propylene oxide with each other and with hydroxyl-containing bases, such as nonyl phenol and Oxo-type alcohols. It is highly preferred that the nonionic detergent be a condensation product of ethylene oxide and higher fatty alcohol. In such products the higher alcohol is of 10 to 20 carbon atoms, preferably 12 to 16 carbon atoms, and the nonionic detergent contains from about 3 to 20 or 30 ethylene oxide groups per mole, preferably from 6 to 12. Most preferably, the nonionic detergent will be one in which the higher fatty alcohol is of about 12 to 13 or 15 carbon atoms and which contains from 6 to 7 or 11 moles of ethylene oxide. Such detergents are made by Shell Chemical Company and are available under the trade name Neodol® 23-6.5 and 25-7, the latter being a condensation product of a mixture of higher fatty alcohols averaging about 12 to 15 carbon atoms and the number of ethylene oxide group per mole averages about 7. Among their especially attractive properties, in addition to good detergency with respect to oily stains on goods to be washed, is a comparatively low melting point, which is still appreciably above room temperature, so that they may be sprayed onto spray dried based beads as a liquid which solidifies.

Zitterionic detergents such as the betaine and sulphobetaines having the following formula are also useful:

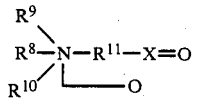

wherein $R^8$ represents an alkyl group containing from about 8 to 18 carbon atoms, $R^9$ and $R^{10}$ each independently represent an alkyl or hydroxyalkyl group containing about 1 to 4 carbon atoms, $R^{11}$represents an alkylene or hydroxyalkylene group containing 1 to 4 carbon atoms, and X represents a carbon atom or an S:O group. The alkyl group can contain one or more intermediate linkages such as amido, ether, or polyether linkages or nonfunctional substituents, such as hydroxyl or halogen which do not substantially affect the hydrophobic character of the group. When X represents a carbon atom, the detergent is called a betaine; and when X represents an S:O group, the detergent is called a sulphobetaine or sultaine.

Ampholytic detergents are also suitable for the invention. Ampholytic detergents are well known in the art and many operable detergents of the class are disclosed by Schwartz, Perry and Berch in the aforementioned "Surface Active Agents and Detergents". Examples of suitable amphoteric detergents include: alkyl betaiminodipropionates, $RN(C_2H_4COOM)_2$; alkyl betaamino propionates, $RN(H)C_2H_4COOM$; and long chain imidazole derivatives having the general formula

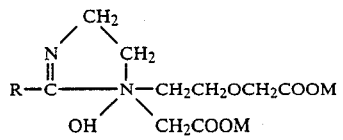

wherein in each of the above formulae R represents an acyclic hydrophobic group containing from about 8 to 18 carbon atoms and M is a cation to neutralize the charge of the anion. Specific operable amphoteric detergents include the disodium salt of undecylcycloimidinum-ethoxyethionic acid-2-ethionic acid, dodecyl beta alanine, and the inner salt of 2-trimethylamino lauric acid.

The amounts of the zwitterionic synthetic organic detergent and the ampholytic synthetic organic detergent when present in the invention composition are not particularly critical and can be selected depending on the desired results. Generally, either or both of these classes of detergent ingredients can be used to replace all or part of the anionic organic detergent surfactant and/or nonionic organic detergent surfactant within the ranges disclosed above.

The detergent compositions of the invention optionally, but preferably, contain at least one detergent builder of the type commonly used in detergent formulations. Useful builders include any of the conventional inorganic water-soluble builder salts, such as, for example, water-soluble salts of phosphates, pyrophosphates, orthophosphates, polyphosphates, tripolyphosphates, silicates, carbonates, bicarbonates, borates, sulfates, and the like. Organic builders include water-soluble phosphonates, polyphosphonates, polyhydroxysulphonates, polyacetates, aminopolyacetates, carboxylates, polycarboxylates, succinates, and the like.

Specific examples of inorganic phosphate builders include sodium and potassium tripolyphosphates, pyrophosphates and hexametaphosphates. The organic polyphosphonates specifically include, for example, the sodium and potassium salts of ethane 1-hydroxy-1, 1-diphosphonic acid and the sodium and potassium salts of ethane-1,1,2-triphosphonic acid. Example of these and other phosphorous builder compounds are disclosed in U.S. Pat. Nos. 3,213,030; 2,422,021; 3,422,137 and 3,400,176. Pentasodium tripolyphosphate and tetrasodium pyrophosphate are especially preferred water-soluble inorganic builders.

Specific examples of non-phosphorous inorganic builders include water-soluble inorganic carbonate, bicarbonate and silicate salts. The alkali metal, for example, sodium and potassium, carbonates, bicarbonates and silicates are particularly useful herein.

Water-soluble organic builders are also useful. For example, the alkali metal, ammonium and substituted ammonium acetates, carboxylates, polycarboxylates and polyhydroxysulphonates are useful builders for the compositions and processes of the present invention. Specific examples of acetate and polycarboxylate builders include sodium, potassium, lithium, ammonium and substituted ammonium salts of ethylene diaminetetracetic acid, nitrilotriacetic acid, benzene polycarboxylic (i.e. penta- and tetra-) acids, carboxymethoxysuccinic acid and citric acid.

Additional organic builder salts useful herein include the polycarboxylate materials described in U.S. Pat. No. 2,264,103, including the water-soluble alkali metal salts of mellitic acid. The water-soluble salts of polycarboxylate polymers and copolymers such as are described in U.S. Pat. No. 3,308,067, are also suitable herein.

Water-soluble builders may also be used, particularly, the complex sodium alumino silicates such as, zeolites, e.g. zeolite 4A, a type of zeolite described hereinabove.

The builder salts, including both the inorganic and organic detergent builder salts are conveniently employed so as to provide in the finished composition, after mixing with the post-added ingredients, from about 5 to 75%, preferably about 20 to 60%, of detergent builder salt(s), based on the total composition.

Various adjuvants may be included in the fully formulated detergent and conditioning composition of the invention as well as in the support (e.g. porous base beads) upon which fabric conditioning compositions are adsorbed and/or absorbed. In general, these include perfumes; colorants, e.g., pigments and dyes; bleaches, such as, sodium perborate; bleach activators; antiredeposition agents, such as, alkali metal salts of carboxymethylcellulose; optical brighteners, such as, anionic, cationic or non-ionic brighteners; foam stabilizers, such as alkanolamides; enzymes; and the like, all of which are well-known in the fabric washing art for use in detergent compositions. Flow promoting agents, commonly referred to as flow aids, may also be employed to maintain the particulate compositions as free-flowing beads or powder. Startch derivatives and special clays are commercially available as additives which enhance the flowability of otherwise tacky or pasty particulate compositions, two of such clay additives being presently marketed under the tradenames "Satintone" and "Microsil". The adjuvants are, of course, selected to be compatible with the main constituents of the composition.

The following examples illustrate the invention, but are not intended to limit the scope thereof.

EXAMPLE I

A commercial granular detergent composition designated herein as "Control A" and a commercial concentrated granular detergent composition designated herein as "Control B" were used in the following examples and had the following composition:

CONTROL A

| Component | Weight Percent |
|---|---|
| Sodium sulfate | 37.7 |
| Pentasodium Tripolyphosphate | 25.5 |
| Linear alkylbenzene sulfonate | 13.5 |
| Soda ash | 4.8 |
| Silicate solids | 6.5 |
| Sodium carboxymethylcellulose | 0.2 |
| Moisture and adjuvants | Balance |

CONTROL B

| Component | Weight Percent |
|---|---|
| Pentasodium tripolyphosphate | 57.7 |
| Ethoxylated $C_{12}$–$C_{15}$ primary alcohol (7 moles EO per mole alcohol) | 20.2 |
| Silicate solids | 9.6 |
| Enzymes | 1.5 |
| Moisture and adjuvants | Balance |

A mixture of 21.5 grams of dimerized oleic acid (sold as Empol 1010 Dimer Acid by Emergy Industries) and 40.0 grams of methyl di(hydrogenated tallow) amine (sold as Armeen M2HT by Armak Chemical Division of Akso Chemie AMerican) were mixed by stirring and then heated at 105° C. for 15 minutes. 6.2 parts of the resulting liquid complex was mixed separately with each of 100 parts of Control A and with 40 parts of Control B. Each of the resulting mixtures as well as the Control A and Control B compositions were used to launder twenty soiled swatches in a U.S. top loading washing machine (17 gal.). The swatches sized 3"×6" were comprised of four each of the following test swatches:

1. Testfabrics Nylon soil cloth
2. Testfabrics Cotton soil cloth
3. Piscataway clay on cotton
4. Piscataway clay on 65 Dacron/35 Cotton
5. Oily Soil EMPA on 65D/35C.

A 5 lb. ballast load was included in the washing machine comprised equally of cotton terry facecloths, cotton percale swatches and 65D/35C (14"×15") swatches having no finish.

The test fabrics and ballast load were washed using a fourteen minute wash cycle with rinse and spin operations followed by drying for two hours in an electric dryer. The reflectance of each swatch was then measured with a Gardner Colorimeter Model XL 805 using the Rd scale (0=black, 100=white), and the difference in Rd value noted between the measured value and the initial value measured prior to washing.

The Soil Removal Index (SRI) reported in Table 1 is a calculated value which reflects the sum of the differences in measured Rd values for the various test swatches washed with a particular laundering composition. The higher the SRI, the greater the degree of cleaning.

To evaluate the anti-static properties, the test swatches were dried with two terry towels for an additional ten minutes in a dryer to evaluate visual static/-cling and the results are reported in Table 1.

The measured static charge reported in Table 1 indicates the absolute charge developed by the friction of a spinning wool swatch on the test fabric. The equipment used for this measurement included a 3M Static Meter Model 703; a Static Eliminator or Zerostat instrument, and a Test Fabrics Wool Flannel No. 503A swatch. The wool swatch was fitted over a 6 cm. plastic disc and spun on a Dremel Tool Model 380 at about 400 rpm for 5 seconds and the covered disc was then brought into light contact with the test swatch. The static Meter was then used to measure the static charge about two inches from the rubbed area.

EXAMPLE 2

A complex in accordance with the invention was prepared by mixing 4.88 parts of citric acid with 40.0 parts of methyl di(hydrogenated tallow) amine and then heating the mixture to 100° C. for 15 minutes. 6.2 parts of the resulting liquid complex was mixed with 100 parts of Control A and then used to launder the soiled swatches as described in Example 1. The results are reported in Table 1.

EXAMPLE 3

A complex not in accordance with the invention was prepared by substituting stearic acid for citric acid in the procedure described in Example 2. The resulting complex was used for laundering as described in Example 1. The cleaning, softening and anti-static effects are reported on Table 1.

EXAMPLE 4

A complex not in accordance with the invention of phthalic acid and methy di(hydrogenated tallow) amine was formed by follwing the procedure of Example 2 except for the substition of phthalic acid for citric acid. The laundering procedure of Example 1 was followed and the results described in Table 1.

TABLE 1

PERFORMANCE COMPARISON OF CARBOXYLIC ACID/AMINE COMPLEXES IN COMMERCIAL DETERGENT COMPOSITIONS

| Formulation | Static Visual | Static Measured | Softness[a] | Cleaning-SRI[b] |
|---|---|---|---|---|
| Control A | Extremely Heavy | 43.1 KV | 0 | 232 |
| Control A + 6.2% dimerized oleic acid/amine (Example 1) | None | 7.4 KV | +3.3 | 224 |
| Control A + 6.2% citric acid/amine (Example 2) | None | 4.2 KV | +5.0 | 221 |
| Control A + 6.2% stearic acid/amine (Example 3) | Light | 10.6 KV | +2.4 | 223 |
| Control A + 6.2% phthalic acid/amine (Example 4) | None | — | +1 | 221 |
| Control B | Extremely Heavy | 37.8 KV | 0 | 224 |
| Control B + 15.5% dimerized oleic acid/amine (Example 1) | Light | 15.0 KV | +1.6 | 210 |

Conditions: Wash cycle, 120° F. for 14 mins. Base compositions: 100 g of Control A or 40 g of Control B
[a]Softness: Based on a scale of 1 (very harsh) to 10 (very soft) relative to Control A or B (considered to be 0) as evaluated by a three member panel.
[b]SRI is the Soil Removal Index. Differences less than ±7 are not considered significant As noted in Table 1, the use of fabric conditioning compositions in accordance with the invention as a detergent additive (Examples 1 and 2) provided very effective anti-static properties and improved softness to laundered test fabrics relative to the commercial control compositions in the absence of such fabric conditioning compositions. In contrast thereto, the use of carboxylic acid/amine complexes not in accordance with the invention (Examples 3 and 4) failed to provide an equivalent improvement in both the anti-static and softening properties relative to Control A.

What is claimed is:

1. A fabric conditioning composition capable of imparting softness and anti-static properties to fabrics treated therewith in a laundry bath without adversely affecting fabric cleaning comprising a fabric conditioning amount of a multicarboxylic acid complex of a tertiary amine formed from (i) an amine having the general formula:

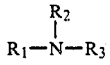

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tri carboxylic acids having 21 to 54 carbon atoms.

2. A fabric conditioning composition according to claim 1 wherein the tertiary amine is methyl distearyl amine.

3. A fabric conditioning composition according to claim 1 wherein the amine is methyl di (hydrogenated tallow) amine.

4. A fabric conditioning composition according to claim 1 wherein $R_2$ and $R_3$ are each an alkyl group.

5. A fabric conditioning composition according to claim 1 wherein the multifunctional carboxylic acid is citric acid.

6. A fabric conditioning composition according to claim 1 wherein the multifunctional carboxylic acid is dimerized oleic acid.

7. A fabric conditioning composition according to claim 1 wherein the multifunctional carboxylic acid is a trimer of oleic acid having 54 carbon atoms.

8. A fabric conditioning composition according to claim 1 wherein the said multicarboxylic acid complex is adsorbed and/or absorbed upon free-flowing porous base beads which comprise by weight from about 50 to 90% of an inorganic or organic detergent builder, the balance comprising water and adjuvants.

9. A fabric conditioning composition according to claim 8 wherein said base beads comprise by weight from about 50 to 90% pentasodium tripolyphosphate.

10. A fabric conditioning composition according to claim 8 wherein said base beads comprise by weight from about 50 to 90% of water softening aluminum silicate.

11. A wash-cycle additive liquid for providing softness and anti-static properties to fabrics treated therewith in a laundry bath comprising:

(a) from about 10 to 30%, by weight, of a fabric conditioning composition according to claim 1;

(b) from about 10 to 30%, by weight, of an emulsifying agent; and (c) the balance water and optionally a compound for providing anti-static properties additional to that provided by said fabric conditioning composition.

12. A detergent and conditioning composition capable of cleaning, softening and imparting anti-static properties to fabrics treated therewith in a laundry bath comprising:

(a) from about 5 to 50%, by weight, of at least one detergent compound;

(b) from about 5 to 75%, by weight, of an inorganic or organic detergent builder;

(c) from about 0.5 to 15%, by weight, of a multi-functional carboxylic acid complex of a tertiary amine formed from (i) an amine having the general formula

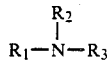

wherein $R_1$ is methyl or ethyl, and $R_2$ and $R_3$ are each independently an aliphatic group having from 12 to 22 carbon atoms; and (ii) a multifunctional carboxylic acid selected from the group consisting of citric acid, and di and tri carboxylic acids having 21 to 54 carbon atoms; and (d) the balance water and optionally a filler salt.

13. A detergent and conditioning composition according to claim 12 wherein the multicarboxylic acid complex is present in an amount of from about 3 to about 9 percent.

14. A detergent and conditioning composition according to claim 12 which contains from about 10 to 20% sodium alkyl benzene sulfonate, and from about 20 to 30% pentasodium tripolyphosphate, the balance comprising water and a filler salt.

15. A detergent and cleaning composition according to claim 12 which contains from about 15 to 25% of a nonionic detergent compound, and from about 50 to 60% of pentasodium tripolyphosphate, the balance comprising water and adjuvants.

16. A detergent and cleaning composition according to claim 12 wherein the tertiary amine is methyl distearyl amine.

17. A detergent and cleaning composition according to claim 12 wherein the amine is methyl di (hydrogenated tallow) amine.

18. A detergent and cleaning composition according to claim 12 wherein the multi-functional carboxylic acid is citric acid.

19. A detergent and cleaning composition according to claim 12 wherein the multi-functional carboxylic acid is dimerized oleic acid.

20. A process for imparting softness and anti-static properties to fabrics comprising the step of contacting the fabrics in a laundry wash or rinse liquor with an effective amount of a fabric conditioning composition comprising a multicarboxylic acid complex of a tertiary amine formed from (i) an amine having the general formula:

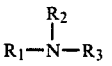

wherein $R_1$ is methyl or ethyl, and $R_2$ and $R_3$ are each independently an aliphatic group having from 12 to 22 carbon atoms, and (ii) a multi-functional carboxylic acid selected from the group consisting of citric acid, and di and tri carboxylic acids having 21 to 54 carbon atoms.

21. A process in accordance with claim 20 wherein the multifunctional carboxylic acid is citric acid.

22. A process in accordance with claim 20 wherein the multifunctional carboxylic acid is dimerized oleic acid.

23. A process in accordance with claim 20 wherein the tertiary amine is methyl di(hydrogenated tallow) amine.

* * * * *